United States Patent [19]

Blättner et al.

[11] Patent Number: 4,698,883

[45] Date of Patent: Oct. 13, 1987

[54] CUTTING AND MOUNTING APPARATUS

[75] Inventors: Dietmar Blättner, Schwaikheim; Hermann Dieterle, Esslingen; Manfred Leutwein, Kernen; Horst Simon, Fellbach, all of Fed. Rep. of Germany

[73] Assignee: Eastman Kodak Company, Rochester, N.Y.

[21] Appl. No.: 871,410

[22] PCT Filed: Oct. 4, 1985

[86] PCT No.: PCT/DE85/00365

§ 371 Date: May 28, 1986

§ 102(e) Date: May 28, 1986

[87] PCT Pub. No.: WO86/02179

PCT Pub. Date: Apr. 10, 1986

[30] Foreign Application Priority Data

Oct. 5, 1984 [DE] Fed. Rep. of Germany ..... 3436537

[51] Int. Cl.[4] ..... G03D 15/10

[52] U.S. Cl. ..... 29/56.5; 29/824; 53/520; 40/158 B; 156/517; 83/160; 83/167

[58] Field of Search ..... 53/520; 29/56.5, 56.6, 29/453, 822–824; 83/160, 167; 40/158 B; 156/517

[56] References Cited

U.S. PATENT DOCUMENTS

| | | | |
|---|---|---|---|
| 3,248,846 | 5/1966 | Engelstein | 53/520 |
| 3,274,665 | 9/1966 | Higginson et al. | 29/33 R |
| 3,707,755 | 1/1973 | Pettersson | 29/56.5 |
| 3,780,608 | 12/1973 | Brown | 83/375 |
| 3,992,243 | 11/1976 | Berggren | 53/520 X |
| 3,996,683 | 12/1976 | Hanke | 40/158 B |
| 4,172,003 | 10/1979 | Bachelder et al. | 156/517 |
| 4,256,527 | 3/1981 | Green | 53/520 X |
| 4,461,105 | 1/1984 | Thebault | 40/152 |

FOREIGN PATENT DOCUMENTS 0009144 8/1979 European Pat. Off. .

*Primary Examiner*—Donald R. Schran

*Attorney, Agent, or Firm*—Robert L. Randall

[57] ABSTRACT

In a cutting and mounting apparatus for cutting a film section (9) which can be lowered into a slide mount (10) positioned below a cutting tool (5) in a slider (7), and which upon withdrawal of slider (7) can be snapped into the slide mount (10) while resting against a guiding jaw (2*a*), said guiding jaw (2*a*) forms part of a cover plate (2) serving for supporting a cutting plate (3) and covering the guide channel (1*a*) of slider (7). The slide mount (10) is urged against the stationary guiding jaw (2*a*) free from play by means of a leaf spring (8) extending below the slider (7). During this operation, the front edge of the film section (9) abuts against an offset abutment edge (2*e*) of the guiding jaw (2*a*) so that the film section (9) is slid into a rear slot of the slide mount (10), is bent and snaps into a front slot in the slide mount (10).

8 Claims, 3 Drawing Figures

CUTTING AND MOUNTING APPARATUS

Figure 1:
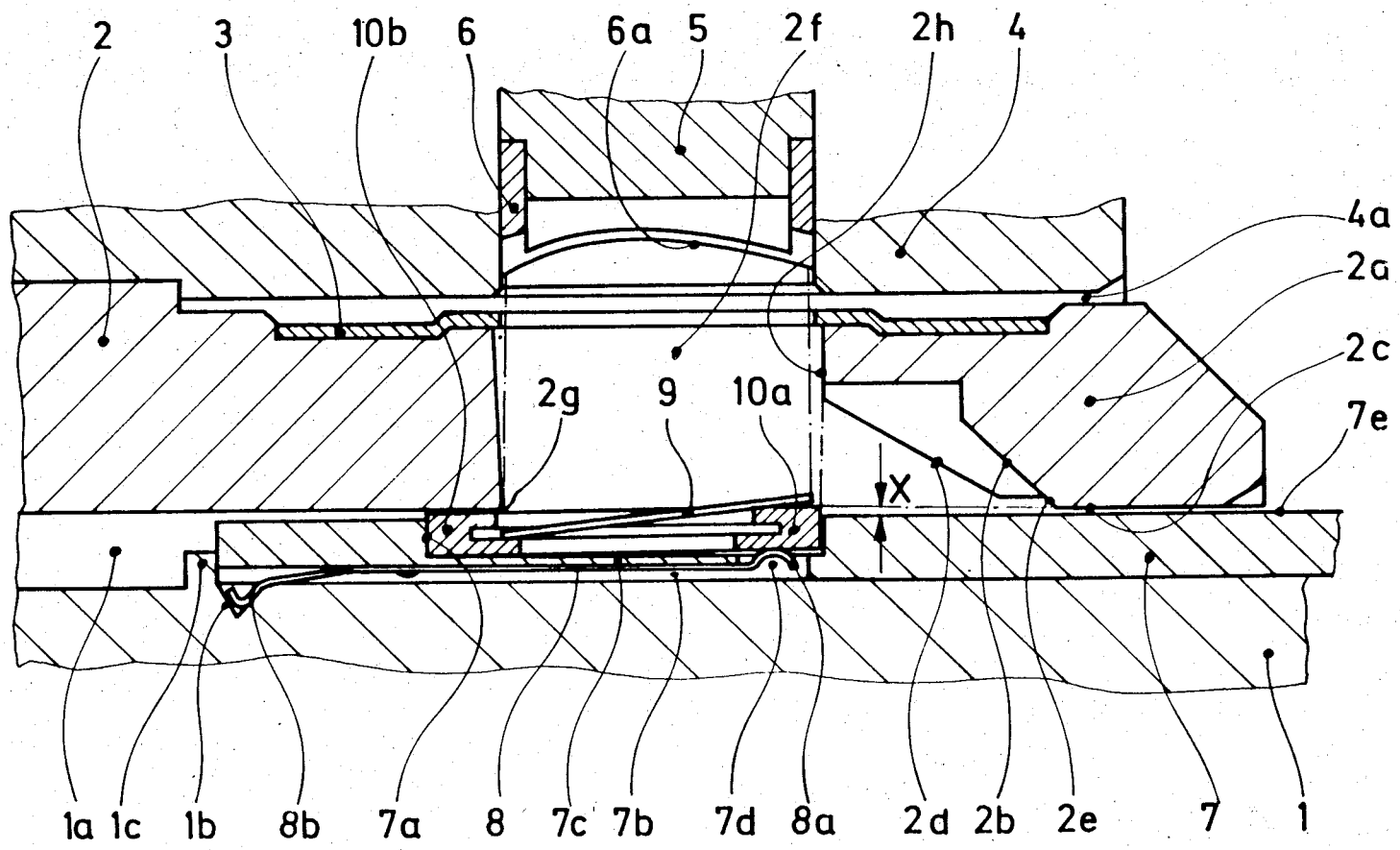

The invention relates to a cutting and mounting apparatus for cutting film sections which can be lowered into a slide mount disposed in a slider below a cutting tool, and which upon withdrawal of the slider can be snapped into the slide mount while resting against a guiding jaw.

From EP-PS No. 0 009 144, a cutting and mounting apparatus is known in the case of which a slide film section can be snapped into a common-type slide mount. This apparatus comprises a slide mount shifting means and has two convex bending jaws facing each other at a distance defined by a film section. Each bending jaw is designed on an abutment and has an impact surface facing downwardly. Both abutments are pivotable and spring-biased so as to rest on the front and rear frame portion, respectively, of a slide mount shiftable below the abutments. The rear abutment is pivotally arranged in a guide block which can be shifted in the longitudinal direction by means of a slider connected to it by a spring so that during a first phase of movement of the shifting means the rear abutment can be moved over a certain distance towards the stationarily and pivotally mounted front abutment across the surface of the slide mount. During this shifting movement, the rear edge of the film section is seized by the impact surface of the bending jaw of the rear abutment and shifted forwardly. During said shifting movement, the film section first engages with its rear edge the area of a groove at the rear frame portion of the slide mount, and then abuts with its front edge the impact surface of the front bending jaw. After the rear abutment has been shifted over a short distance, the slide mount starts shifting and is first slid with its front frame portion below the front abutment. Since the film section is supported with its rear edge in the groove of the rear frame portion and rests with its front edge against the impact surface of the front bending jaw, the central area of the film section bends upwardly upon further shifting of the slide mount and snaps into a groove in the front frame portion of the slide mount.

The known shifting means includes a great number of movable parts and therefore has an extremely complicated construction. Moreover, its manufacture is expensive.

It is the object of the invention to modify and improve the shifting means of the known cutting and mounting apparatus such that pivotally movable components are not necessary, and that the shifting means functions reliably despite a simple construction of the apparatus.

According to the invention, this object is achieved in that a resilient means is provided urging the slide mount free from play against the stationary guiding jaw.

In a particularly advantageous modification, the guiding jaw is rigid and forms part of a cutting plate, or part of a cover plate serving to support a cutting plate and covering the guide channel of the slider.

In another advantageous modification, the resilient means is designed as a leaf spring extending below the slider.

In a further modification of the invention, the leaf spring is arranged in a recess at the lower side of the slider, and the free end of a resilient arm of the leaf spring, projecting in the direction of extension of the slider, includes a curved portion which projects through an opening in the bottom surface of an indentation accommodating the slide mount and designed in the upper side of the slider, rests against the slide mount and lifts it by at least the width of a gap between the upper side of the slider and the lower side of the guiding jaw.

In the case of the apparatus according to the invention, the guiding jaw necessary for snapping the film section into the slide mount forms an integral part with a component which is required anyway for supporting the cutting plate and covering the guide channel of the slider. In spite of a gap between the slider and the guiding jaw, the slide mount is guided accurately and free from play when passing below the guiding jaw.

Other features and advantages can be inferred from the other subclaims and from the description of two embodiments of the invention illustrated in the drawings.

Figure 2:
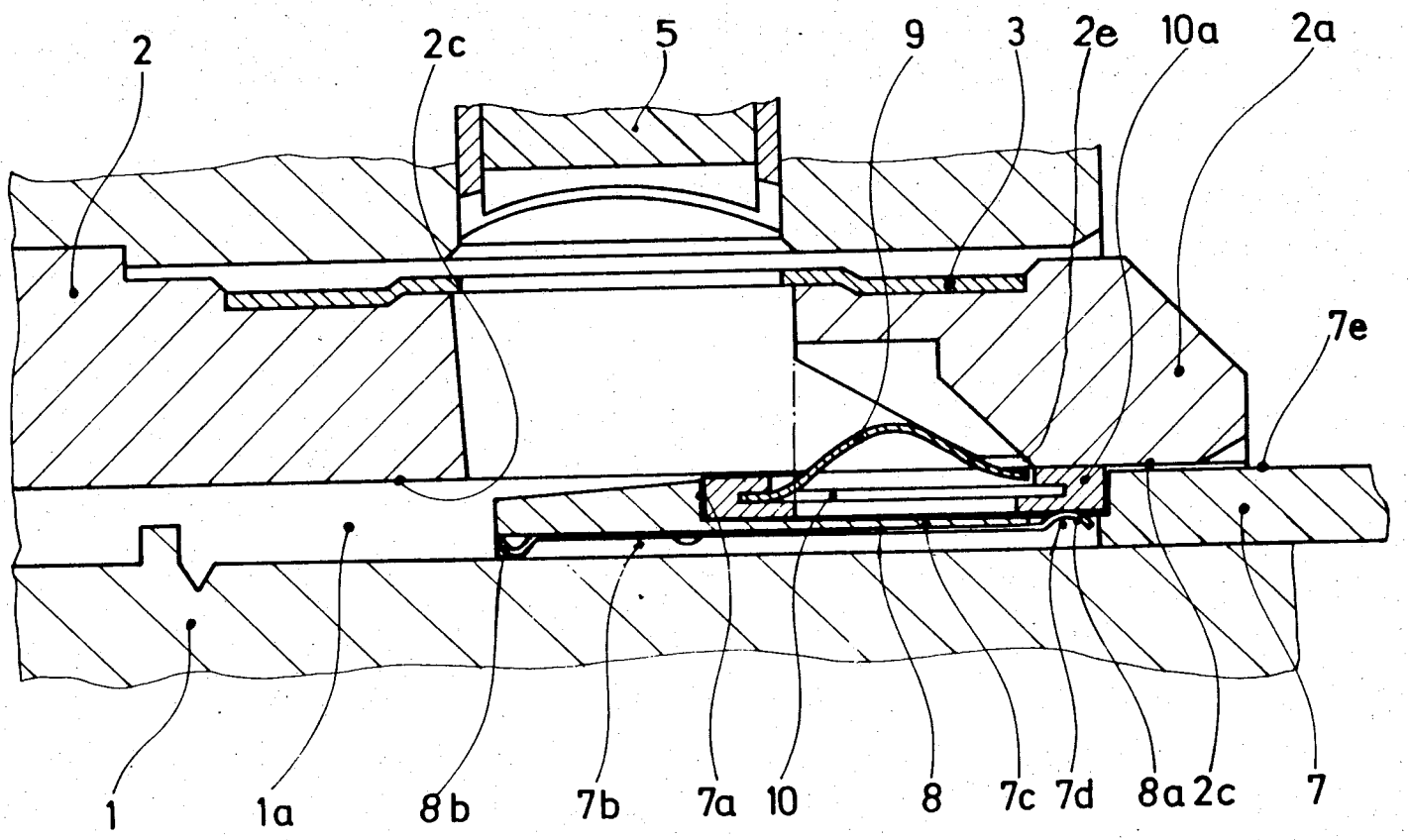
Figure 3:
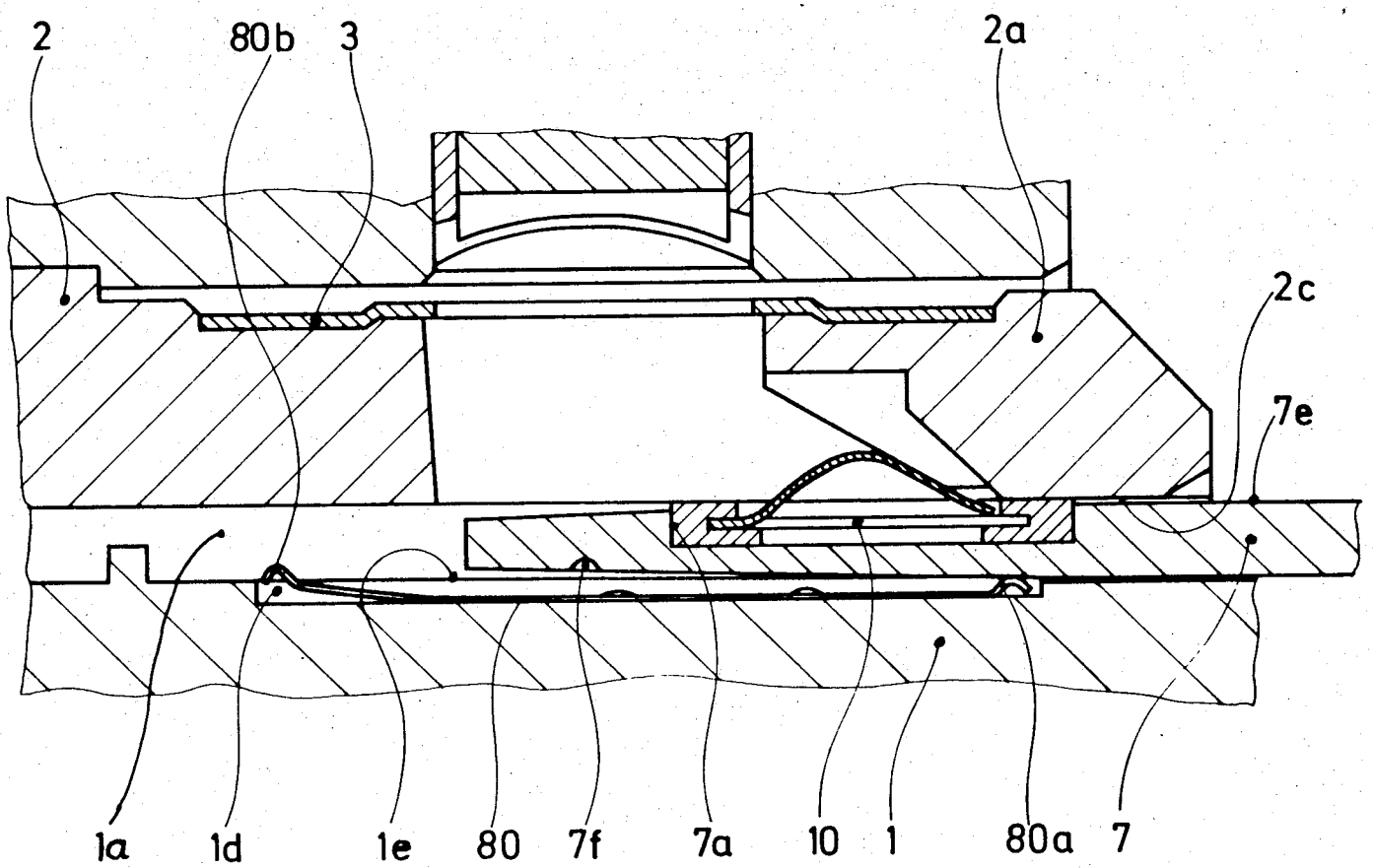

In the drawings:

FIG. 1 is a sectional side view of part of the cutting and mounting apparatus with a shifting means in a first functional position, FIG. 2 is a sectional side view of the apparatus according to FIG. 1 with a shifting means in a second functional position, and FIG. 3 is a sectional side view of the apparatus according to FIG. 2 with a further embodiment of a shifting means.

A base plate 1 includes a guide channel 1*a* for a slider 7 which can be retracted until it reaches a stop 1*c*. The guide channel 1*a* is covered by a cover plate 2 arranged on the base plate 1 and serving to support a cutting plate 3. The slider 7 is easily shiftable. A narrow gap "X" exists between the upper side 7*e* of the slider 7 and the lower side 2*c* of the cover plate 2. A tool guide 4 is placed on top of the cover plate 2. In said guide, a cutter block 6 of a tool 5 is guided, which has four cutting blades 6*a*. Reference numeral 4*a* relates to a gap between the cutting plate 3 and the tool guide 4. Into this gap, a film can be slid, off which a film section 9 is to be cut. The film section can be lowered through a chute 2*f* which is provided downstream of the cutting plate 3 in the cover plate 2 and has walls slightly inclined inwardly. The film section 9 reaches a common-type slide mount 10 which is located below the chute end and is suitable for film sections to be snapped into.

The slide mount 10 is positioned in an indentation 7*a* of slider 7. The position of the indentation 7*a* is chosen such that when the slider 7 rests against stop 1*c*, the rear edge of the upper greater gate opening of slide mount 10 is at least aligned with the lower edge 2*g* of the rear wall of the chute, or lies slightly behind said lower edge 2*g*. The front frame portion 10*a* of the slide mount 10 is located within the chute at the front end thereof. Since the two lateral edges of the upper greater gate opening of slide mount 10 are substantially aligned with the two lateral edges of the chute end as well, the film section 9 is guided such that it reacts with its rear edge against the inwardly facing rear marginal area of the lower smaller gate opening of slide mount 10, whereas the front area of film section 9 rests against the upper side of the front frame portion of slide mount 10.

That part of cover plate 2, which is located in the direction of extension of slider 7, is designed as a rigid guiding jaw 2*a*. It has a wall 2*b* which projects from the front chute wall 2*h* downwardly at a substantially inclined position and turns into the lower side 2*c*. Two laterally arranged, inclined ribs 2*d* are provided on the wall 2*b*, the lower end faces of said ribs being offset with respect to the lower side 2*c* of the guiding jaw 2*a* so that a downwardly projecting abutment edge 2*e* is formed.

In a first embodiment, the lower side of slider 7 has a recess 7*b* in which a leaf spring 8 is arranged. The free end of a spring arm pointing in the direction of extension of slider 7 includes a curved portion 8*a* which projects through an opening 7*d* in the bottom surface 7*c* of slider 7. According to the embodiment, the opening 7*d* is positioned in the area of the front frame portion 10*a* of slide mount 10, said portion lying in the direction of extension of slider 7. The leaf spring 8 rests via the curved portion 8*a* against the front frame portion 10*a* of slide mount 10 and lifts said slide mount at one end by at least the width "X" of the gap between the upper side 7*e* of slider 7 and the lower side 2*c* of the guiding jaw 2*a*. This leads to the front area of the upper side of slide mount 10 being spring-biased so as to rest free from play against the lower side 2*c* of the guiding jaw 2*a* when the slider 7 is extended (FIG. 2). This ensures that the front edge of a film section 9 fully abuts the edge 2*e* of the guiding jaw which is rigid and forms an integral unit with the cover plate 2, the film section 9 being slid into the groove in the rear frame portion 10*b* of slide mount 10, bent upwardly along the inclined ribs 2*b* and then snapped into the groove of slide mount 10, which is provided in the front frame portion 10*a*.

A locking member 8*b* is provided at the free end of a spring arm of leaf spring 8, which extends backwardly. When the slider 7 is fully retracted, this locking member 8*b* engages with a V-shaped notch in the bottom surface 1*e* of the guide channel 1*a* of base plate 1 and urges the slider 7 into contact with the stop 1*c*.

In a further embodiment (FIG. 3), the leaf spring 80 is arranged in a recess 1*d* in the bottom surface 1*e* of the guide channel 1*a*. The free end of said spring, which is located in the direction of extension of slider 7, comprises a curved portion 80*a* lying opposite the guiding jaw 2*a* and resting against the lower side of slider 7. This causes the slider to be slightly urged upwardly, and the upper side of slide mount 10 to rest on the lower side 2*c* of the guiding jaw 2*a* free from play.

At the free end of a backwardly extending spring arm of leaf spring 80 a locking member 80*b* is provided which when the slider 7 has been retracted engages with a notch 7*f* in the lower side of slider 7 and holds slider 7 in contact with stop 1*c*.

We claim:

1. In a cutting and mounting apparatus for cutting a film section which is then lowered into a slide mount, said apparatus comprising a cutting tool including a cutting plate disposed in a cover plate, and a slide member disposed in a guide channel beneath the cover plate, said slide member being provided with a recess in the upper surface thereof for receiving a slide mount, said slide member being arranged to move between a first position wherein the slide mount is disposed in alignment with and beneath said cutting plate and a second position wherein the slide mount is disposed exteriorly of said apparatus, and a guiding jaw member disposed between said cutting plate and said slide member and arranged to engage a film section disposed on the upper surface of a slide mount carried by said slide member so that, as the slide member is moved in said guide channel to withdraw the slide mount from the apparatus, said film section is engaged and deflected by said guiding jaw member and is snapped into said slide mount, the improvement comprising a resilient member disposed in said guide channel in engagement with the lower surface of said slide member and arranged to resiliently urge the slide mount against the lower surface of said cover plate.

2. The invention according to claim 1 wherein said guiding jaw member is a substantially stationary surface formed in said cover plate.

3. The invention according to claim 1 wherein said resilient means is a leaf spring disposed on the lower surface of the slide member.

4. The invention according to claim 3 wherein said leaf spring is disposed in a recess in the lower surface of said slide member and wherein the slide member is provided with an opening beneath the slide mount recess through which a first end of said leaf spring projects to apply an upward force to a slide mount disposed within the slide mount recess.

5. The invention according to claim 4 wherein said leaf spring is arranged to force that portion of the slide mount into engagement with the lower surface of said cover plate.

6. The invention according to claim 5 wherein the second end of said leaf spring is provided with a locking portion and the bottom surface of said guide channel is provided with a recess engagable by said locking portion of said leaf spring to accurately locate said slide member in alignment with said cutter member.

7. The invention according to claim 1 wherein said resilient means is a leaf spring disposed in said guide channel and arranged to urge the slide member and said slide mount against the lower surface of said cover plate.

8. The invention according to claim 7 wherein an end of said leaf spring is provided with a locking portion and the lower surface of said slide member is provided with a recess engagable by said locking portion of said leaf spring to accurately locate said slide member in alignment with said cutter member.

* * * * *